US005662395A

United States Patent [19]

Lechman

[11] Patent Number: 5,662,395

[45] Date of Patent: Sep. 2, 1997

[54] UNDERDESK COMPUTER DESK STRUCTURE WITH ANTIREFLECTING VIEWING WINDOW

[75] Inventor: John N. Lechman, Effingham, Ill.

[73] Assignee: Nova Solutions, Inc., Effingham, Ill.

[21] Appl. No.: 475,888

[22] Filed: Jun. 7, 1995

Related U.S. Application Data

[63] Continuation of Ser. No. 895,511, Jun. 8, 1995, abandoned.

[51] Int. Cl.[6] ..... A47B 21/00

[52] U.S. Cl. ..... 312/194; 312/223.3

[58] Field of Search ..... 312/194, 196, 312/7.2, 223.3, 114; 108/50, 161, 23

[56] References Cited

U.S. PATENT DOCUMENTS

| | | |
|---|---|---|
| D. 278,956 | 5/1985 | Gordon . |
| 3,531,178 | 9/1970 | Wirth . |
| 3,706,485 | 12/1972 | Fawcett et al. . |
| 3,712,711 | 1/1973 | Adachi . |
| 3,748,766 | 7/1973 | Hoesch . |
| 3,761,160 | 9/1973 | Apfel et al. . |
| 3,781,090 | 12/1973 | Sumita . |
| 3,799,653 | 3/1974 | Ikeda . |
| 3,858,965 | 1/1975 | Sumita . |
| 3,922,068 | 11/1975 | Uetsuki . |
| 3,940,136 | 2/1976 | Runte . |
| 3,960,441 | 6/1976 | Kamiya et al. . |
| 3,984,581 | 10/1976 | Dobler et al. . |
| 4,128,303 | 12/1978 | Onoki et al. . |
| 4,130,672 | 12/1978 | Onoki et al. . |
| 4,264,133 | 4/1981 | Sakurai . |
| 4,370,027 | 1/1983 | Sato et al. . |
| 4,387,960 | 6/1983 | Tani . |
| 4,425,022 | 1/1984 | Ludwig . |
| 4,590,866 | 5/1986 | Schairbaum . |
| 4,595,106 | 6/1986 | Kunze et al. . |
| 4,599,272 | 7/1986 | Ichikawa . |
| 4,723,091 | 2/1988 | Kawamura et al. . |
| 4,726,654 | 2/1988 | Kimura et al. . |
| 4,749,255 | 6/1988 | Chakrabarti et al. . |
| 4,753,516 | 6/1988 | Doi et al. . |
| 4,755,009 | 7/1988 | Price et al. . |
| 4,759,990 | 7/1988 | Yen . |
| 4,784,467 | 11/1988 | Akatsuka et al. . |
| 4,798,994 | 1/1989 | Rijpers et al. . |
| 4,802,737 | 2/1989 | Denton . |
| 4,995,684 | 2/1991 | Tustison et al. . |
| 5,002,726 | 3/1991 | Austin et al. . |
| 5,004,320 | 4/1991 | Nagai et al. . |
| 5,071,204 | 12/1991 | Price et al. . |
| 5,091,244 | 2/1992 | Biornard . |
| 5,105,310 | 4/1992 | Dickey . |
| 5,125,727 | 6/1992 | Lechman et al. . |

FOREIGN PATENT DOCUMENTS

| | | |
|---|---|---|
| 1106895 | 8/1981 | Canada . |
| WO 88/07826 | 10/1988 | WIPO . |
| WO 93/25118 | 12/1993 | WIPO . |

OTHER PUBLICATIONS

Brochure entitled "Anti-Reflection—Product Descriptions," published by Viratec Thin Films, Inc., Faribault, Minnesota (pub. date unknown, but believed to be prior to Jun. 1992).

Kenney, J. G., "Anti-Reflective Coating for Prescription Lenses," Opt. J. Rev. Optom., vol. 111, No. 7, pp. 7–9, (Apr. 1, 1974).

*Primary Examiner*—James R. Brittain
*Assistant Examiner*—Gerald A. Anderson
*Attorney, Agent, or Firm*—Olson & Hierl, Ltd.

[57] ABSTRACT

A desk structure is provided wherein a monitor is angularly positionable beneath a transparent viewing window in the working surface thereof. The window is provided with a coating which is antireflecting of incident exterior light but the window is transmissive of light images from the monitor viewing screen.

5 Claims, 1 Drawing Sheet

UNDERDESK COMPUTER DESK STRUCTURE WITH ANTIREFLECTING VIEWING WINDOW

This is a continuation of application Ser. No. 07/895,511, filed Jun. 8, 1995, now abandoned.

FIELD OF THE INVENTION

This invention relates to workstations and desk structures of the type having an undersurface monitor support and a transparent viewing window in the working surface thereof wherein the window is antireflecting but still transmissive of light images from the monitor held by the monitor support.

BACKGROUND OF THE INVENTION

Desk structures having a supported monitor located under a window in the working surface are known; see, for example, Schairbaum U.S. Pat. No. 4,590,866 or Lechman et al. U.S. Pat. No. 5,125,727.

Although such desk structures are coming into wide usage, one problem associated with their use is the reflection of incident light from the smooth surface portions of the window. Not only can the reflected incident light cause discomfort to the user, but the reflected incident light can also interfere with the viewability of images appearing on the monitor screen beneath the window. Hood structures can be provided on the top of the desk working surface which circumscribe side, back and even overhead portions of the window, but such a hood structure can interfere with the usability of the working surface.

Antireflecting transparent members of glass or plastic that are adapted for placing over pictures and the like are known, but these members inherently have a somewhat hazy appearance which evidently is due to the fact that striking incident light is effectively diffused and reflected therefrom at random angles by minute surface irregularities. While such an arrangement is satisfactory for the viewing of adjacently placed objects (such as a painting), it is unsatisfactory for the viewing of relatively remotely placed objects located behind such a transparent member (such as a monitor screen) because of the increasing inability to see such a remote object clearly and sharply with increasing object distances from the transparent member. Also, see, for example, Denton U.S. Pat. No. 4,802,737 and Doi et al. U.S. Pat. No. 4,753,516.

So far as now known, the provision of a window in such an undersurface monitor equipped desk structure which is both antireflecting of incident exterior light and also transmissive of light images appearing on the face of the monitor screen with the monitor being in spaced relationship to the window has not previously been achieved.

SUMMARY OF THE INVENTION

This invention relates to an improved desk structure with a top member that is provided with a generally transparent window and with a monitor holding means located beneath or behind the top member for viewability through the window. The window is antireflecting particularly of the screen of a so held monitor with respect to incident exterior light, yet is transmissive of light images emitted from the screen of a so held monitor with the monitor being in spaced relationship relative to the window. High resolution capacities are achieved.

The desk structure overcomes the foregoing disadvantages of prior art window-equipped, monitor support equipped desk structures with regard to monitor viewability in the presence of reflected incident light.

Also, the desk structure avoids the need for any hood structure or the like to accomplish incident light shielding.

Further, the inventive combination avoids the foregoing problems of transmittance and resolution capacity associated with certain prior antireflecting glass or plastic articles that bear a roughened surface.

In addition, the inventive combination incorporates a window which provides an optimized combination of reflectance, transmittance and resolution capacity for use in such combination.

The window employed in the inventive combination has an antireflecting coating on at least one of its opposed surfaces, most preferably on the upper surface only, and such coating is either a single layer, or, preferably, a multilayer structure.

Other and further objects, aims, features, purposes, advantages, embodiments and the like will be apparent to those skilled in the art from the accompanying specification and appended drawings.

DETAILED DESCRIPTION (a)The Desk Structure

Figure 1:
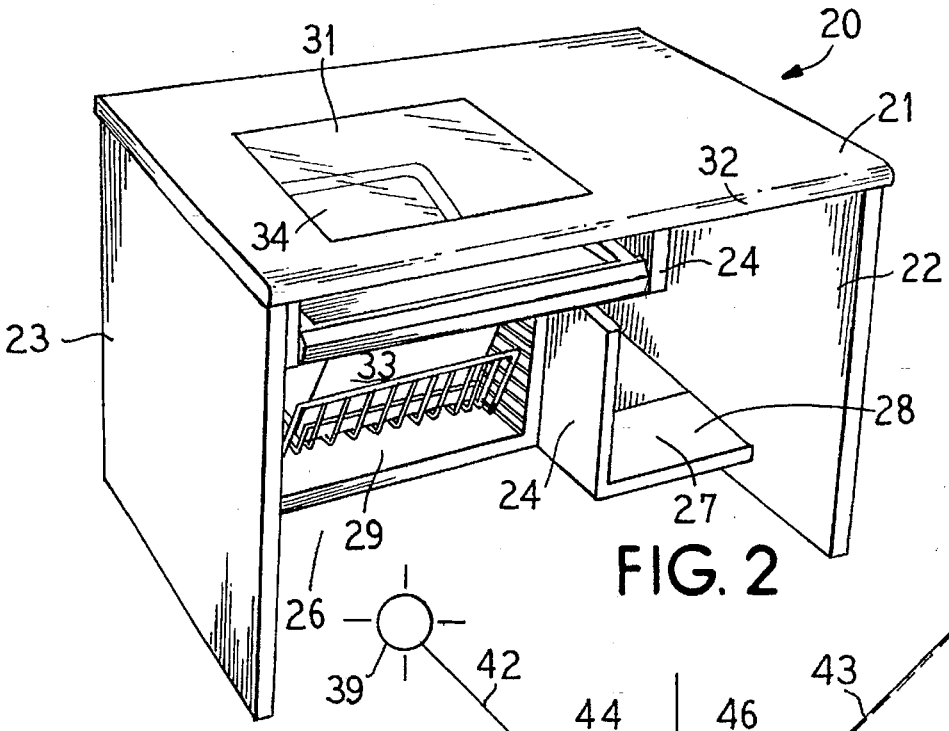
FIG. 1 is a perspective view of one embodiment of a desk structure of this invention.

Referring to FIGS. 1–5, there is seen an illustrative desk structure 20 that has a top, flat, generally horizontally extending surface member 21 that is supported in spaced relationship to a floor surface by a pair of laterally spaced vertical side walls 22 and 23 and by a vertical back wall (not shown).

Desk structure 20 further includes an interior support partition 24 which has a discontinuous forward edge region and which terminates in spaced relationship to the floor. Partition 24, and walls 22 and 23, are conventionally fastened to adjacent portions of the underside of top member 21 and the back wall. A kneehole 26 is defined between partition 24 and side wall 23, and a storage area 27 is defined between partition 24 and side wall 22. Storage area 27 is provided with a bottom shelf 28 that is mounted between the bottom of partition 24 and the inside of side wall 22. Also, another shelf 29 is provided between the bottom of partition 24 and the inside of side wall 22 in the rear interior of the kneehole 26.

Desk structure 20 can be variously configured and constructed without, departing from the scope of this invention.

Inset into the surface member 21 is a window 31 which is located over the kneehole 26 in a transversely spaced relationship relative to the forward edge 32 of surface member 21.

Mounted in the kneehole 26 is a monitor holding means which is adapted to hold a monitor 33 in an angled configuration so that light images emitted from the monitor 33 viewing surface (or screen) 34 (comprising the forward end of a cathode ray tube within monitor 33) can be viewed through the window 31 by a user (not shown) who is seated at kneehole 26 and whose head is located above and in generally spaced relationship to forward edge 32.

Any convenient monitor holding subassembly can be used which supports or suspends the monitor 33 in a desired configuration below and in generally spaced relationship to window 31. A present preference is to employ a monitor support 36 as disclosed in Lechman et al. U.S. Pat. No. 5,125,727 which is adjustably connected and comprised of interwelded wire members.

Under the surface member 21 and extending generally across the kneehole 26 is slidably mounted a transversely short keyboard holding platform 37 that is slidable transversely from the closed position shown in FIG. 1 to a fully outwardly extended position sufficient to expose a keyboard (not shown) that is supported by platform 37. While any convenient subassembly can be used for platform 33 and its slidable mounting means, the structure shown in copending U.S. patent application Ser. No. 774,416 filed Oct. 10, 1991 now U.S. Pat. No. 5,205,631 issued Apr. 27, 1993 is now preferred (the disclosure of such application being incorporated herein by reference).

A central processing unit (CPU, not shown) for interconnecting with the keyboard and with the monitor 33 by cables (not shown) can be housed, if desired, in the desk structure 20; for example, on shelf 28. Alternatively, the CPU can be remotely situated (relative to the desk structure 20), if desired.

A printer (not shown) that is interconnected with the keyboard, the monitor 33 and the CPU by cables (not shown) also can be housed, if desired, in the desk structure 20; for example, on shelf 28. Alternatively, the printer can be remotely situated (relative to the desk structure 20).

Figure 2:
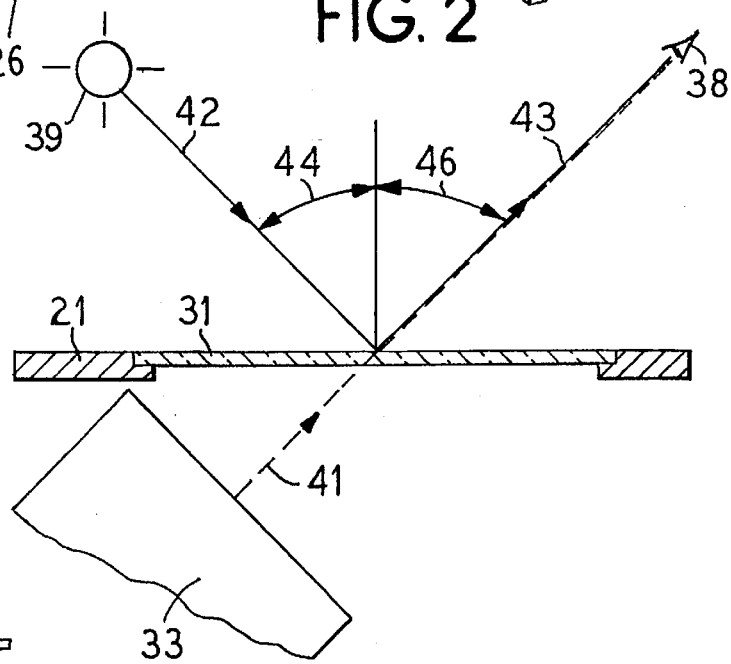
FIG. 2 is a schematic diagram illustrating the transmittance and reflecting light paths associated with a window in a desk structure such as shown in FIG. 1.

In usage, as illustrated schematically in FIG. 2, images generated on the screen 34 of monitor 33 are emitted and pass through the window 31 for viewing by the eye 38 of a user, as illustrated by the dotted line light path 41 in FIG. 2 (refraction in window 31 not being shown). A viewing problem is potentially generated when light, for example, light from a room light source 39, strikes the upper exposed surface of window 31 and is reflected therefrom to the eye 38 of the user, as illustrated by the solid line light paths 42 and 43 in FIG. 2 (the angle of incidence 44 being equal to the angle of reflection 46). Depending upon existing circumstances, the reflected external light can interfere with the viewability of the screen image according to the prior art. In the present invention, the window 31 is coated on at least one of its opposed surfaces with an antireflecting coating (not shown in FIGS. 1 and 2) which substantially eliminates the incident light reflection problem so that light path 43 is preferably eliminated.

(b)The Window

The window employed in a desk structure of this invention comprises a transparent substrate which has opposed, parallel faces, and which is coated on at least one face thereof (preferably the upper or outer face only) with an antireflecting coating. The substrate is comprised of an inorganic glass or an organic plastic. The exact thickness of the substrate is unimportant, but the substrate needs to be at least thick enough to have structural strength and stability sufficient for desk top usage. Preferably, the substrate is at least about 1 centimeter in thickness. A tinted substrate can be used, if desired.

Since, from the standpoint of commercial practicality, an individual monitor that is selected for use by a user with a desk structure 20 can emit (predetermined) useful light images whose frequency and wavelength may occur over portions of a spectral range that extends over the entire visible spectrum, the window preferably needs to be transparent to light over the visible range. Also, since exterior light that strikes the exposed face (or surface of the window) can have a frequency and wavelength which occurs within the visible spectrum, the antireflecting coating chosen preferably needs to be effective over this spectral range. Since the human eye has a sensitivity that decreases to zero below about 400 nm and above about 700 nm, this is the spectral range (or band) of interest. Thus, the window substrate (whether glass or plastic) should be generally transmissive of light in this band, and also the antireflecting coating should be effective for reducing reflection of incident light in this band.

The index of refraction of the window substrate can vary and needs no special value for present purposes, particularly since antireflecting coatings can be adjusted for use with substrates of differing refractive indices. The reflectance of the uncoated substrate can also vary. Glass, for example, reportedly has a reflectance of about 4.9% (see Rijpers et al. U.S. Pat. No. 4,798,994).

For the present invention, it is now preferred to utilize a window which has a photopic transmittance of at least about 50% generally across the visible spectrum. Lower values are possible and can be used. Such low values may occur because of the absorption effect of the antireflecting coating. While such lower transmittance values can be used, such as when the substrate is tinted, those values are generally considered to be less desirable. More preferred is a window having a photopic transmittance of at least about 60%.

Also, for the present invention, it is now preferred to utilize a window which has a resolution capacity for transmitted images (that is, images from a monitor that have passed through a window) which is at least about 90% and which is more preferably at least about 95%.

(c) The Antireflecting Coating

The antireflecting coating functions to reduce the reflection of incident light at the exposed window surface.

The thickness of such a coating is variable, being dependent upon construction and composition as those skilled in the art will appreciate but is usually substantially less than about one millimeter.

A considerable number of antireflection coatings have been suggested in the prior art for a primary design purpose of ensuring that the residual reflectance from a reflecting surface will be held to a relatively small value over the entire range of the visible spectrum. Although single or double layer coatings provide considerable improvement, such either have a residual reflectance that is less than here desired or the range of suppressing the reflectance over the visual spectrum is limited. Also, single layer coatings can degrade in antireflecting capacity with time. To improve these restrictions, it is here preferred to employ antireflection coatings having three or more layers.

For the present invention, it is now preferred to utilize a coated substrate (or window) which has an antireflecting coating that has a photopic reflectance of not more than about 1% (measured generally across the visible spectrum) and more preferably not more than about 0.3%.

An example of a single layer antireflecting coating comprises a film of $MgF_2$ that is vacuum vapor deposited on the surface of a substrate which is cleaned and heated to temperatures of 150°–350° C. (See Onoki et al. U.S. Pat. No. 4,130,672). Another example of such a single layer coating is provided by Ichikawa U.S. Pat. No. 4,599,272 which describes the single layer as being a mixture of $MgF_2$ and $SiO_2$.

An example of a two layer antireflecting coating comprises outer and inner layers having thicknesses of λ/4 and λ/2 (see Fawcett et al. U.S. Pat. No. 3,706,485). Also, the inner layer can be a silicon oxide (SiO) film and the outer layer can be a silicon dioxide ($SiO_2$) film wherein the inner layer has a thickness of λ/2 and the outer layer has a thickness of λ/4 (see Onoki et al. U.S. Pat. No. 4,130,672).

The value of λ, as those skilled in the art will appreciate, is a design wavelength that is selected as a representative wavelength lying within the band width chosen. Since, in the visible spectrum, the human eye has a peak sensitivity at about 550 nm (nanometers), λ is here conveniently selected to be this value.

A three layer antireflecting coating can have layer thicknesses of λ/4, λ/2 and 3λ/4, respectively (see, for example, Fawcett et al U.S. Pat. No. 3,706,485 and Sakurai U.S. Pat. No. 4,264,133). In Sakurai '133, the third layer itself can be multiple layers for inhomogeneity adjusting purposes. Individual layers can have various compositions. A three-layer antireflecting coating is also described by Adachi U.S. Pat. No. 3,712,111. A coating of at least three layers is described by Rijpers et al. U.S. Pat. No. 4,798,994. A three layer antireflecting coating incorporating an incidence layer, a reflecting layer and a reflection-reducing layer is described by Ludwig U.S. Pat. No. 4,425,022 who employs two different components in his reflection-reducing layer. Another three layer type of antireflecting coating is described by Sato et al. U.S. Pat. No. 4,370,027 which coating incorporates a low refractive index layer, a high packing density layer and a layer of plural pairs of alternative layers (one of which has a low refractive index and the other of which has a high refractive index).

A four layer antireflecting coating is provided, for example, by Tani U.S. Pat. No. 4,387,960 where, in each layer, the relationship between optical thickness and refractive index are related to the preselected design wavelength so that the thickness of each successive layer is approximately 0.25λ, 0.50λ, 0.75λ and 0.25λ from the outermost layer to the innermost layer adjacent the substrate. Various inorganic oxides can be chosen for each layer. A wide band antireflecting coating of at least four layers is provided by Apfel et al. in U.S. Pat. No. 3,761,160. Four layer antireflecting coatings are also described by Sumita U.S. Pat. No. 3,781,090. A composite four layer type antireflecting coating is provided by Onoki et al. U.S. Pat. No. 4,128,303 which has (a) a medium refractive index layer, (b) four sequential high refractive index layers, (c) three thin layers of $MgF_2$, and (d) a low refractive index layer.

A five layer antireflecting coating is exemplified by Sumita U.S. Pat. No. 3,858,965 wherein, with respect to the preselected design wavelength λ, the outermost layer has an optical thickness (based on refractive index and coating thickness) ranging from 0.260 to 0.230λ, the second layer has an optical thickness of from 0.600 to 0.400λ, and the third, fourth and fifth layers each have an optical thickness in the range from 0.500 to 0.250λ. Various oxides are described for individual layers. Another five layer antireflecting coating is described by Uetsuki U.S. Pat. No. 3,922,068.

An antireflecting coating comprised of at least six layers is taught by Kimura et al. U.S. Pat. No. 4,726,654 who teaches an index of refraction and an optical thickness for each layer.

A seven layer antireflecting coating is exemplified by Kamiya U.S. Pat. No. 3,960,441. At least four alternate layers are each composed of a material having a low refractive index with the interleaved three layers each being composed of a material having a low refractive index. Another seven layer antireflecting coating is described by Ikeda U.S. Pat. No. 3,799,653.

Antireflecting coatings which can be organic in composition and which are placed on organic plastic substrates are exemplified by Akatsuka et al. U.S. Pat. No. 4,784,467, Yen U.S. Pat. No. 4,759,990, and Dobler et al. U.S. Pat. No. 3,984,581.

The art generally appreciates that impact and wear resistance can be imparted to antireflecting coatings; see, for example, Tustison et al U.S. Pat. No. 4,995,684.

Figure 3:
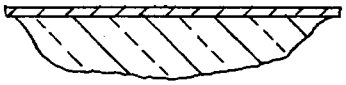
FIGS. 3, 4 and 5 each illustrate a fragmentary, enlarged view of a coated window structure that is usable in the practice of this invention.
Figure 4:
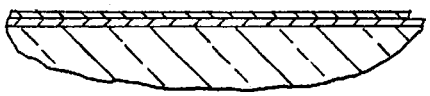
Figure 5:
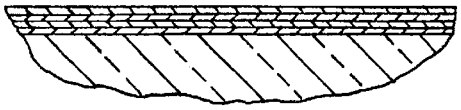

For present illustration purposes, the appearance in cross-section under high magnification of (a) a single layered antireflecting coating is shown in FIG. 3, (b) a two layered antireflecting coating is shown in FIG. 4, and (c) a four layered antireflecting coating is shown in FIG. 5. Variables such as index of refraction or coating thickness are not shown, but are described in the prior art (such as in the foregoing illustrative U.S. patents, the disclosures of which are incorporated by reference).

The best window 31 now known for use in the desk structure of this invention is available commercially from Viratec Thin Films, Inc., Faribault, Minn. under the trademark "CDAR". This window is now believed to have (from information supplied by the manufacturer) a glass substrate, a photopic reflectance of not more than about 0.25%, a photopic transmittance of about 62%, and a resolution capacity of at least about 95%. The antireflecting coating apparently includes five layers which are believed to be prepared as described in Dickey U.S. Pat. No. 5,105,310 (incorporated herein by reference).

Many other different and alternative arrangements are possible for a desk structure of this invention, including its various components, as those skilled in the art will appreciate. For example, the monitor can be located so as to protrude above the horizontal working surface at a rear portion of the working surface when the monitor is in use. In this arrangement, a window, such as a window 31, is positioned in front of the monitor and is associated with a portion of the desk top member so that the monitor screen is visible through the window by a user seated at a front portion of the top member.

As used herein, the term "photopic" refers to vision by means of retinal cones.

The term "reflectance" refers to the ratio of reflected flux to incident flux. Total reflectance is conveniently considered.

The term "transmittance" has reference to the ratio of the radiant power (locally) transmitted by a source to the incident radiant power as comparatively measured on opposed sides of a window.

Moreover, the term "resolution" refers to the comparative ability measured in percent or the like of a window to transmit therethrough the points, lines and surfaces shown, for example, on a monitor screen that is in spaced relationship to the window. Distortion of originating monitor image characteristics, especially clarity (sharpness or acuity and, sometimes, intensity) as viewed through the window reduces resolution.

Various other and further embodiments, applications, structures and the like will be apparent to those skilled in the art from the teachings herein provided and no undue limitations are to be drawn therefrom.

What is claimed is:

1. A desk structure comprising:

(a) a top member having a working surface portion;

(b) means for supporting said top member in spaced relationship to an underlying floor and defining with said top member an opening along one side of said desk for receiving the knees of a user seated at the desk structure;

(c) transparent window means associated with a portion of said top member; and (d) means located in said desk structure generally behind said top member for holding a monitor behind said top member, said so held monitor and said window means being positioned relative to one another so that said monitor is viewable through said window means by said seated user;

said window means having generally opposed parallel side surfaces and being transmissive of light images emitted from said monitor and passing angularly through said window means, at least one of said opposed surfaces having a coating which is antireflecting of exterior environmental light striking said window means, said coating being comprised of at least one antireflecting material layer;

said window means being further characterized by having a photopic reflectance of not more than about 1%, a photopic transmittance of at least about 50%, and a resolution capacity of at least about 90%.

2. The desk structure of claim 1 wherein said coating comprises at least one antireflecting, light transmissive layer on an upper surface portion of said window means.

3. The desk structure of claim 1 wherein said coating comprises multiple layers.

4. The desk structure of claim 1 wherein said window means has a photopic reflectance of not more than about 0.3%, a photopic transmittance of at least about 60%, and a resolution capacity of at least about 95%.

5. The desk structure of claim 4 wherein said window means includes a coating of at least five layers.

* * * * *